US007431522B2

(12) United States Patent
Linville et al.

(10) Patent No.: US 7,431,522 B2
(45) Date of Patent: Oct. 7, 2008

(54) METHOD FOR REDUCING BANDING IN AN IMAGING APPARATUS

(75) Inventors: Kenneth Wayne Linville, Georgetown, KY (US); Randall David Mayo, Georgetown, KY (US); Bohong Zhang, Lexington, KY (US)

(73) Assignee: Lexmark International, Inc, Lexington, KY (US)

( * ) Notice: Subject to any disclaimer, the term of this patent is extended or adjusted under 35 U.S.C. 154(b) by 188 days.

(21) Appl. No.: 11/333,686

(22) Filed: Jan. 17, 2006

(65) Prior Publication Data

US 2007/0172282 A1 Jul. 26, 2007

(51) Int. Cl.
*B41J 11/00* (2006.01)

(52) U.S. Cl. ..... 400/582; 400/633; 347/19

(58) Field of Classification Search ..... 400/76, 400/582, 633; 347/19, 37, 41
See application file for complete search history.

(56) References Cited

U.S. PATENT DOCUMENTS 6,336,702 B1 * 1/2002 Zapata et al. ..... 347/41
6,567,110 B2 * 5/2003 Yergenson ..... 347/115
6,682,173 B1 * 1/2004 Shaked et al. ..... 347/43
6,698,858 B1 * 3/2004 Askeland et al. ..... 347/12
7,036,904 B2 * 5/2006 King et al. ..... 347/19

* cited by examiner

*Primary Examiner*—Minh H Chau
(74) *Attorney, Agent, or Firm*—Taylor & Aust PC

(57) ABSTRACT

A method for reducing banding during printing with an imaging apparatus includes establishing a current original move length; determining a current original absolute position; calculating a current adjusted absolute position based on the current original absolute position; determining a current difference between the current original absolute position and the current adjusted absolute position; determining a current move-to-move adjustment amount by subtracting the current difference from a previous difference between a previous original absolute position and a previous adjusted absolute position; and generating an adjusted move length for a next move by adding the current move-to-move adjustment amount to the current original move length.

13 Claims, 2 Drawing Sheets

METHOD FOR REDUCING BANDING IN AN IMAGING APPARATUS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to an imaging apparatus, and, more particularly, to a method for reducing banding during printing with an imaging apparatus.

2. Description of the Related Art

In prior art, a typical ink jet printer forms an image on a print medium by ejecting ink from at least one ink jet printhead to form a pattern of ink dots on the print medium. Such an ink jet printer includes a reciprocating printhead carrier that transports one or more ink jet printheads across the print medium along a bi-directional scanning path defining a print zone of the printer. The bi-directional scanning path is oriented parallel to a main scan direction, also commonly referred to as the horizontal direction. The main scan direction is bi-directional. During each scan of the printhead carrier, the print medium is held stationary. An indexing mechanism is used to incrementally advance the print medium in a sheet feed direction, also commonly referred to as a sub-scan direction or vertical direction, through the print zone between scans in the main scan direction, or after all data intended to be printed with the print medium at a particular stationary position has been completed.

For a given stationary position of the print medium, printing may take place during one or more unidirectional scans of the printhead carrier. As used herein, the term "unidirectional" is used to refer to scanning in either, but only one, of the two bi-directional scanning directions. Thus, bi-directional scanning refers to two successive unidirectional scans in opposite directions. The term "printing swath" typically refers to the depositing of ink on the print medium during a particular unidirectional scan of the printhead carrier at which time individual printhead nozzles of the printhead are selectively actuated to expel ink. A printing swath is made of a plurality of printing lines traced along imaginary rasters, the imaginary rasters being spaced apart in the sheet feed direction.

Typically, each ink jet printhead will include a plurality of ink jet nozzles arranged in one or more substantially vertical columns for expelling the ink. In ink jet printing, it is common to use the ink colors of cyan, magenta, yellow and black in generating color prints. Also, it is common in ink jet printing to have a printhead having a dedicated nozzle array for each of cyan, magenta and yellow inks, respectively, wherein the three nozzle arrays are aligned vertically, that is, aligned in a direction parallel to the sub-scan direction.

Those working in the imaging arts continually strive to improve the print quality of imaging devices, such as ink jet printers. One such attempt is directed to reducing the occurrence of horizontal banding defects in printouts generated by an ink jet printer. Horizontal banding defects may be observed on media, such as paper, as a horizontal white or a horizontal dark band. Such defects are generally attributable to errors generated by the media sheet indexing mechanism that is used to advance a media sheet in a media feed direction through the printer during the printing of the text or image on the media sheet. Such errors can be caused, for example, by mechanical tolerances of the index roller and its associated drive train. Contributing to this error are variations in the print swath height caused by variations in the height of the printhead. It is known to attempt to mask such indexing errors by adopting an interlaced printing method, also referred to. as shingling, wherein each scan of the printhead carrier (also sometimes referred to in the art as a printhead carriage) is made to vertically overlap a preceding scan. For a given swath, only a portion of the total print data for a given area on the print medium is printed. Thus, each scan of an actuated printhead produces a swath of printed output forming all or portions of multiple print lines, and multiple swaths may be required to complete the printing of any given print line. In some applications, however, such masking techniques may not be adequate to achieve the desired print quality.

SUMMARY OF THE INVENTION

The invention, in one form thereof, is directed to a method for reducing banding during printing with an imaging apparatus. The method includes establishing a current original move length; determining a current original absolute position; calculating a current adjusted absolute position based on the current original absolute position; determining a current difference between the current original absolute position and the current adjusted absolute position; determining a current move-to-move adjustment amount by subtracting the current difference from a previous difference between a previous original absolute position and a previous adjusted absolute position; and generating an adjusted move length for a next move by adding the current move-to-move adjustment amount to the current original move length.

The invention, in another form thereof, is directed to a method to change the feed rate of a printer, including applying discrete adjustments to at least some of all of a plurality of print moves such that the same total move correction is applied over any arbitrarily chosen effective printhead height in an image.

The motivation for the methods of the present invention can be understood by considering the implication of a paper feed mechanism that feeds the paper slightly less than the desired amount. The effect of this in a shingled mode is that the nozzle that should print on a given raster ends up short of the location of the first nozzle that printed on that raster. Eventually the error can become large enough that the nozzle will actually print in the wrong raster. This deviation after each move is very small and often too small to correct by making a correction to the length of the paper feed move. However, once the error builds up to the smallest paper feed move increment, then one increment can be added. This keeps the error in the paper feed direction to about the size of the smallest paper feed increment. Thus, there may be several moves per correction, wherein some moves receive correction and some moves do not receive correction.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
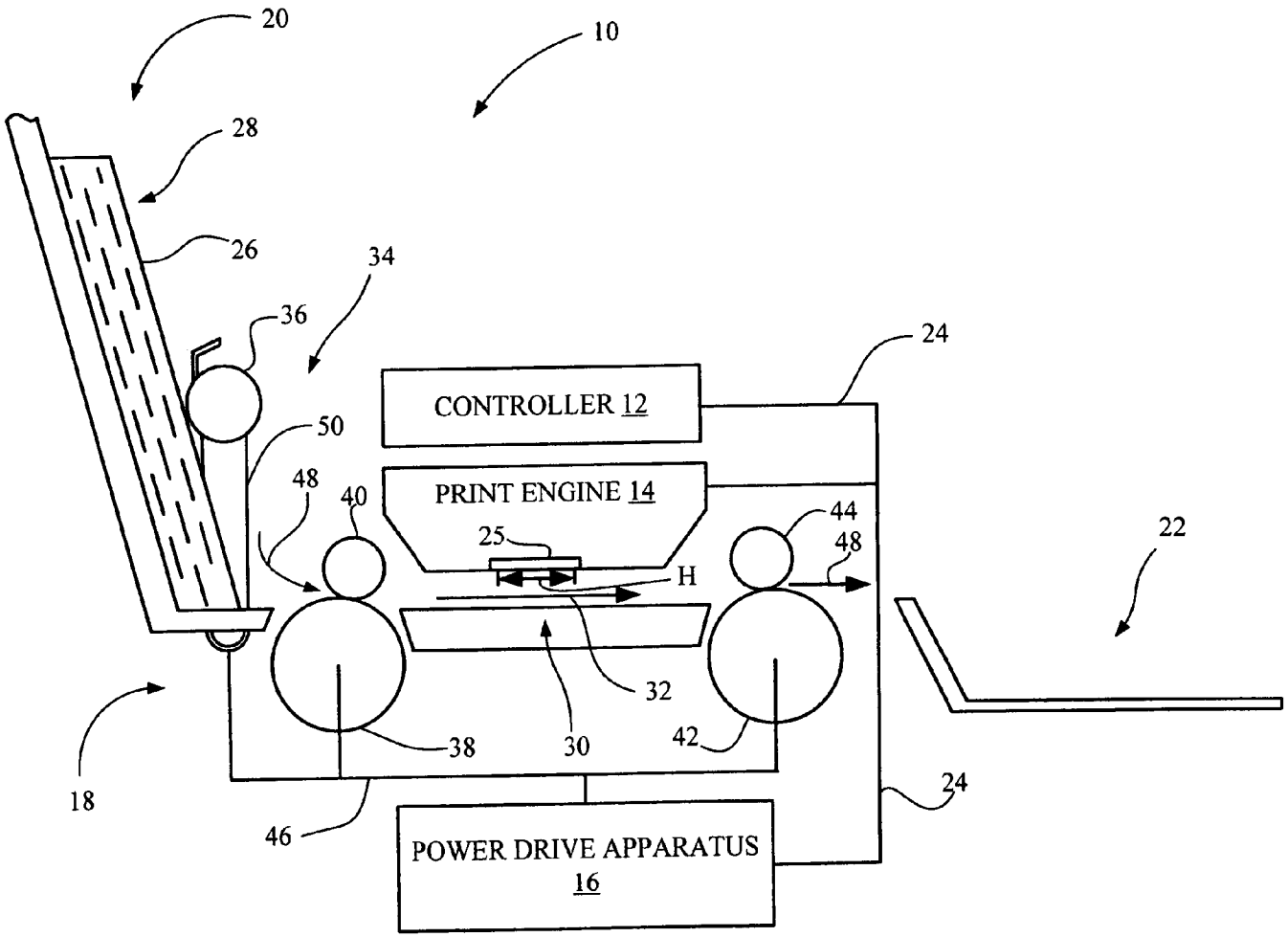
FIG. 1 is a diagrammatic representation of an imaging apparatus embodying the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

Referring to FIG. 1, there is shown a diagrammatic representation of an imaging apparatus 10 embodying the present invention. Imaging apparatus 10 includes a controller 12, print engine 14, a power drive apparatus 16, a media transport system 18, a media supply tray 20 and a media exit tray 22. Controller 12 is communicatively coupled to each of power drive apparatus 16 and print engine 14 via a communications link 24.

As used herein, the term "communications link" generally refers to structure that facilitates electronic communication between two or more components, and may operate using wired or wireless technology. Accordingly, communications link 24 may be, for example, one of, or a combination of, a bus structure, a direct electrical wired connection, a direct wireless connection (e.g., infrared or radio frequency (r.f.)), or a network connection (wired or wireless), such as for example, an Ethernet local area network (LAN) or a wireless networking standard, such as IEEE 802.11.

In one embodiment, for example, imaging apparatus 10 may be a printer, such as for example an ink jet printer utilizing an ink jet print engine as print engine 14. In another embodiment, for example, imaging apparatus 10 may be an all-in-one (AIO) machine having printing and copying functionality in addition to scanning functionality, although in the embodiment shown in FIG. 1, a scanning device for supporting the scanning functionality is not shown. In the ink jet embodiments, print engine 14 may include a reciprocating printhead carrier that carries one or more ink jet printheads 25 in a main scan direction substantially perpendicular to a media feed direction 32, and which is operated under the control of controller 12.

As is known in the art, each ink jet printhead may include a columnar array of ink jetting nozzles. In one embodiment of such a printhead, for example, the ink jet printhead may have a columnar array of 160 nozzles having an effective nominal printhead height (H), i.e., a distance between the first nozzle and the last nozzle used in the array, of $^{160}/_{600}$ths of an inch. In another embodiment, for example, not all of the nozzles are used, e.g., 152 nozzles, resulting in an effective nominal printhead height (H) of $^{152}/_{600}$ths of an inch. Those skilled in the art will recognize that the number of nozzles and the effective printhead nominal height (H) may be increased or decreased from the examples described above.

Controller 12 may be, for example, an application specific integrated circuit (ASIC) having programmed and/or programmable processing capabilities. Controller 12 may include, for example, semiconductor memory, such as for example, random access memory (RAM), read only memory (ROM), and/or non-volatile RAM (NVRAM). Controller 12 may include in its memory a software or firmware program including program instructions that function as a driver for print engine 14. Accordingly, the driver, as a software or firmware program, executed by controller 12 may include a printer driver that places print data and print commands in a format that can be recognized by print engine 14.

Power drive apparatus 16 and media transport system 18 are used to transport a media sheet 26, such as a paper, transparencies, etc., from the stack of media sheets 28 held in media supply tray 20, to, through and from an imaging area 30 of print engine 14 to media exit tray 22 in media feed direction 32.

Media transport system 18 includes a sheet picking device 34 having a pick roller 36; a feed roller set 38 and corresponding pinch roller set 40; and an exit roller set 42 and corresponding backup roller set 44. Power drive apparatus 16 is drivably coupled via a transmission device 46, diagrammatically illustrated by interconnected lines, to each of sheet picking device 34, feed roller set 38 and exit roller set 42.

Power drive apparatus 16 may include as a power source a motor, such as a direct current (DC) motor or a stepper motor. Transmission device 46 may be, for example, a set of gears and/or belts, and clutches configured to transmit a rotational force to the respective rollers at the appropriate time, in conjunction with commands supplied to power drive apparatus 16 from controller 12. Feed roller set 38 and exit roller set 42 may be drivably coupled together, for example, via a pulley/belt system or a gear train. A position of the sheet of media 26 in relation to printhead 25 may be determined and maintained as a cumulative absolute position, based for example, on counting steps moved by the stepper motor in embodiments where such a power source is used.

In the embodiment shown, media supply tray 20 combines with print engine 14 to define a media path 48, which in this embodiment defines an L-shaped media path through imaging apparatus 10. It is contemplated, however, that media supply tray 20 may be of other configurations, such as wherein media supply tray 20 is oriented substantially horizontally, such that media path 48 is defined as a substantially flat media path through imaging apparatus 10. As a further alternative, media supply tray 20 may be connected via a C-shaped paper path having additional rollers.

Sheet picking device 34 is configured to automatically pick a media sheet, such as media sheet 26, from the stack of media sheets 28 located in media supply tray 20, and is sometimes implemented in the art by a mechanism commonly referred to as an auto compensator pick device. Sheet picking device 34 includes a pick arm 50 containing a plurality of gears that are drivingly coupled to sheet pick roller 36. Further, sheet pick roller 36 is positioned by pick arm 50 to contact the top media sheet in the stack of media sheets 28 in media supply tray 20. The picked sheet is conveyed in media feed direction 32 to feed 10 roller set 38, which under the control of controller 12, incrementally feeds the picked sheet of media, e.g., the sheet of media 26, in an indexed fashion during printing.

Figure 2:
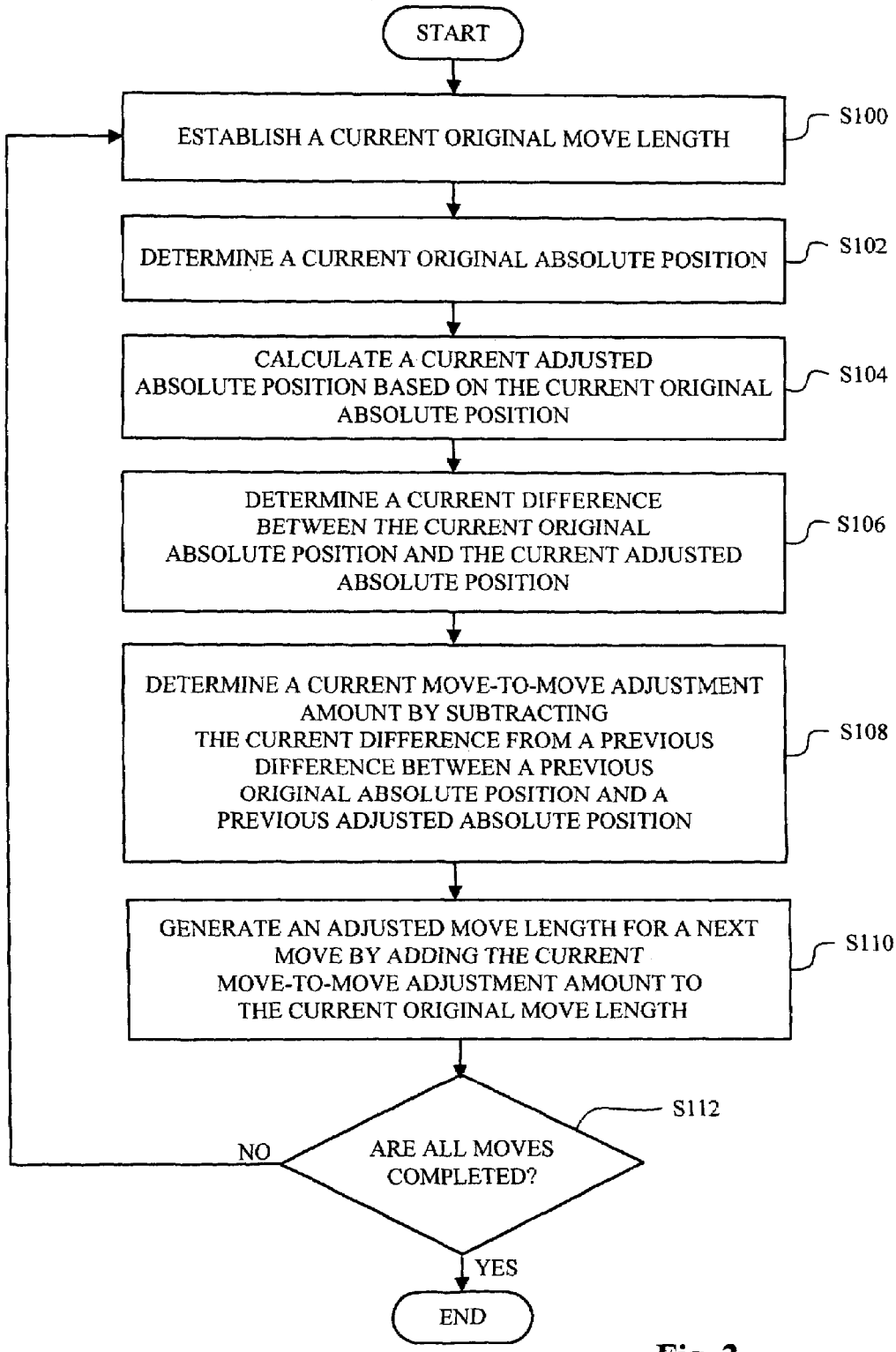
FIG. 2 is a flowchart of a method for reducing banding during printing with an imaging apparatus, in accordance with an embodiment of the present invention.

FIG. 2 is a flowchart of a method for reducing banding during printing with an imaging apparatus, such as imaging apparatus 10, wherein imaging apparatus 10 currently has a media underfeed that results in dark bands being present in the printed image. The method may be implemented, for example, by program instructions executed by the processor of controller 12 of imaging apparatus 10, or alternatively, by a processor of a host computer (not shown) communicatively coupled to imaging apparatus 10, and may include the printer driver, in whole or in part.

In the examples that follow, it has been determined to increase the media feed per effective printhead height by $^{3}/_{2400}$ths of an inch for plain paper and $^{4}/_{2400}$ths of an inch for glossy paper, resulting in an overall federate increase of 0.47% and 0.63%, respectively. The increase of effective media feed rate for glossy paper is larger than for plain paper, for example, due to increased media slippage in feed roller set 38 associated with the glossy surface of the glossy paper. Those skilled in the art will recognize that the increase in effective feed rate may be increased or decreased from these exemplary increases. Various results are demonstrated in the spreadsheets included in Appendices A, B, C, D, E, and F that follow this section. Another advantage is the ability to change the feed rate as required.

At step S100, a current original move length, i.e., for the next print media move, is established. The original move length may change during the printing of the page. For example, in one embodiment for printing plain paper with a full head height, the original move length from one move to the next may alternate between $^{158}/_{1200}$ths of an inch and $^{162}/_{1200}$ths of an inch (i.e., $^{1264}/_{9600}$ths of an inch and $^{1296}/_{9600}$ths of an inch), as illustrated for example in Appendix A. In another embodiment for edge-to-edge printing using one-half the printhead height, for example, the sequential moves, in $^{1}/_{1200}$ths of an inch, may be a repeating pattern of [50, 158, 50, 50], as illustrated for example in Appendix C. Those skilled in the art will recognize that other patterns of sequential original moves may be established, for example, depending on the number of printing swaths used to complete printing of a particular print line.

At step S102, a current original absolute position is determined. Assume, for example, that the original absolute position for the first printing pass is zero (0), then, for plain paper where the original move lengths are established to alternate between $^{1264}/_{9600}$ths of an inch and $^{1296}/_{9600}$ths of an inch, the sequence of original absolute positions, in 9600ths, are 1264, 2560, 3824, 5120, 6384, etc., as illustrated in Appendix A.

At step S104, a current adjusted absolute position is calculated based on the current original absolute position. The following exemplary equation may be used in performing this calculation:

$$\text{AdjAbsPos}=\text{int}((3*\text{OrigAbsPos}+\text{Divisor}/2)/\text{Divisor})+\text{OrigAbsPos}$$

wherein:

AdjAbsPos is the current adjusted absolute position;

int is a function performing real number truncation to form an integer;

OrigAbsPos is the current original absolute position; and

Divisor is an established constant that is based on an effective printhead height.

The Divisor is chosen such that for any effective printhead height group of moves, the same amount of correction is applied. This is to insure that the increase is evenly spread down the page. For example, if the effective printhead height is $^{160}/_{2400}$ths of an inch, i.e., $^{640}/_{9600}$ths of an inch, where the standard is to use 9600ths of an inch, then the Divisor in this example will be 640 and the original absolute position for the first move is 1264. Accordingly, based on the equation above the adjusted absolute position is 1270, as illustrated in Appendix A. For the next move, the Divisor is again 640, the original absolute position is 2560, and the adjusted absolute position is 2572, etc.

Table I, below, shows an exemplary Divisor that may be used for each of a plurality of particular printing modes, and an associated effective adjusted feed rate. In this example, the print modes include plain paper normal, plain paper normal edge-to-edge (E2E), plain paper normal edge-to-edge (E2E) using one-half printhead height, best using one-half printhead height, best (fall printhead height) and normal glossy.

TABLE I

Exemplary Divisor for Each of a Plurality of Printing Modes

| | Divisor | Effective Adjusted Feed Rate % |
|---|---|---|
| Plain Paper Normal | 640 | 0.469 |
| Plain Paper Normal E2E | 624 | 0.481 |
| Plain Paper Normal E2E, ½ Head | 616 | 0.487 |
| Best ½ Head | 432 | 0.694 |
| Best | 456 | 0.658 |
| Normal Glossy | 468 | 0.641 |

At step S106, a current difference between the current original absolute position and the current adjusted absolute position is determined. Thus, for example, as illustrated in Appendix A, the difference between the original absolute position for the first move of 1264 and the adjusted absolute position of 1270 is 6; the difference between the original absolute position for the second move of 2560 and the adjusted absolute position of 2572 is 12, etc., as illustrated in Appendix A.

At step S108, a current move-to-move adjustment amount is determined by subtracting the current difference determined in step S106 from a previous difference, wherein the previous difference is the difference between a previous original absolute position and a previous adjusted absolute position. Thus, referring to Appendix A, the current move-to-move adjustment amount for the first media move after printing has started is the difference between the previous difference of zero (0) and the current difference of 6, which is a current move-to-move adjustment amount of 6, i.e., $6/9600$ths; the current move-to-move adjustment amount for the second media move is the difference between the previous difference of 6 and the current difference of 12, which is a current move-to-move adjustment amount of 6, i.e., $6/9600$ths; etc.

At step S110, an adjusted move length is generated for a next move by adding the current move-to-move adjustment to the amount to the original move length. For example, as illustrated in Appendix A, if the original move length is 1264 (i.e., $1264/9600$ths), then the adjusted move length is 1270 (i.e., $1270/9600$ths); if the original move length is 1296 (i.e., $1296/9600$ths), then the adjusted move length is 1302 (i.e., $1302/9600$ths); etc.

At step S112, it is determined whether all the media moves are completed. If YES, then the process is complete and the page has been completely printed. If NO, then the process returns to step S100. In other words, steps S100-S110 are repeated until all media moves during printing are completed, as illustrated in the example of Appendix A.

Appendices B, C, D, E and F illustrate other examples in using the method described above, demonstrating variations in the effective printhead height, divisor, and/or original move lengths, as indicated in the respective Appendix.

In implementing the present invention, if media transport system 18 is not capable of moving, for example, in 9600ths of an inch increments, such as in the case where the smallest increment of the media transport system is $1/2400$ths of an inch, then the move is truncated to a whole 2400ths of an inch, and the remainder is carried over to the next move. For example, if an adjusted move length of $1270/9600$ths of an inch is desired, the whole 2400ths move is $317/2400$ths (i.e., $1268/9600$ths), and thus, $2/9600$ths will be carried over and added to the next adjusted move length, e.g., $1302/9600+2/9600=1304/9600$ (i.e., $326/2400$ths).

APPENDIX A

Print Mode: Plain Paper Normal
Print Head Nozzles Used: 160
The divisor is used to determine the change in the original move length to attain the desired feedrate change while only altering the feedrate over print-head height by an integer value of 1 (2400ths)
Passes 2
divisor (4*9600ths) = 640

| Original move length (1200ths) | Original move length (9600ths) | Original Absolute Position (9600ths) | Adjusted Absolute Position (9600ths) | Difference between original Abs Pos and adjusted Abs Pos (9600ths) | Move to Move adjustment amount (9600ths) | Adjusted move length (9600ths) | Adjusted Feedrate % |
|---|---|---|---|---|---|---|---|
| 158 | 1264 | 1264 | 1270 | 6 | 6 | 1270 | 0.46875 |
| 162 | 1296 | 2560 | 2572 | 12 | 6 | 1302 | |
| 158 | 1264 | 3824 | 3842 | 18 | 6 | 1270 | |
| 162 | 1296 | 5120 | 5144 | 24 | 6 | 1302 | |
| 158 | 1264 | 6384 | 6414 | 30 | 6 | 1270 | |
| 162 | 1296 | 7680 | 7716 | 36 | 6 | 1302 | |
| 158 | 1264 | 8944 | 8986 | 42 | 6 | 1270 | |
| 162 | 1296 | 10240 | 10288 | 48 | 6 | 1302 | |
| 158 | 1264 | 11504 | 11558 | 54 | 6 | 1270 | |
| 162 | 1296 | 12800 | 12860 | 60 | 6 | 1302 | |
| 158 | 1264 | 14064 | 14130 | 66 | 6 | 1270 | |
| 162 | 1296 | 15360 | 15432 | 72 | 6 | 1302 | |
| 158 | 1264 | 16624 | 16702 | 78 | 6 | 1270 | |
| 162 | 1296 | 17920 | 18004 | 84 | 6 | 1302 | |
| 158 | 1264 | 19184 | 19274 | 90 | 6 | 1270 | |
| 162 | 1296 | 20480 | 20576 | 96 | 6 | 1302 | |
| 158 | 1264 | 21744 | 21846 | 102 | 6 | 1270 | |
| 162 | 1296 | 23040 | 23148 | 108 | 6 | 1302 | |
| 158 | 1264 | 24304 | 24418 | 114 | 6 | 1270 | |
| 162 | 1296 | 25600 | 25720 | 120 | 6 | 1302 | |
| 158 | 1264 | 26864 | 26990 | 126 | 6 | 1270 | |
| 162 | 1296 | 28160 | 28292 | 132 | 6 | 1302 | |
| 158 | 1264 | 29424 | 29562 | 138 | 6 | 1270 | |
| 162 | 1296 | 30720 | 30864 | 144 | 6 | 1302 | |
| 158 | 1264 | 31984 | 32134 | 150 | 6 | 1270 | |
| 162 | 1296 | 33280 | 33436 | 156 | 6 | 1302 | |
| 158 | 1264 | 34544 | 34706 | 162 | 6 | 1270 | |
| 162 | 1296 | 35840 | 36008 | 168 | 6 | 1302 | |
| 158 | 1264 | 37104 | 37278 | 174 | 6 | 1270 | |
| 162 | 1296 | 38400 | 38580 | 180 | 6 | 1302 | |
| 158 | 1264 | 39664 | 39850 | 186 | 6 | 1270 | |

APPENDIX B

Print Mode: Plain Paper Normal E2E
Print Head Nozzles Used: 156
The divisor is used to determine the change in the original move length to attain the desired feedrate change while only altering the feedrate over print-head height by an integer value of 1 (2400ths)
Passes 2
divisor (4*9600ths) = 624

| Original move length (1200ths) | Original move length (9600ths) | Original Absolute Position (9600ths) | Adjusted Absolute Position (9600ths) | Difference between original Abs Pos and adjusted Abs Pos (9600ths) | Move to Move adjustment amount (9600ths) | Adjusted move length (9600ths) | Adjusted Feedrate % |
|---|---|---|---|---|---|---|---|
| 154 | 1232 | 1232 | 1238 | 6 | 6 | 1238 | 0.48076923 |
| 158 | 1264 | 2496 | 2508 | 12 | 6 | 1270 | |
| 154 | 1232 | 3728 | 3746 | 18 | 6 | 1238 | |
| 158 | 1264 | 4992 | 5016 | 24 | 6 | 1270 | |
| 154 | 1232 | 6224 | 6254 | 30 | 6 | 1238 | |
| 158 | 1264 | 7488 | 7524 | 36 | 6 | 1270 | |
| 154 | 1232 | 8720 | 8762 | 42 | 6 | 1238 | |
| 158 | 1264 | 9984 | 10032 | 48 | 6 | 1270 | |
| 154 | 1232 | 11216 | 11270 | 54 | 6 | 1238 | |
| 158 | 1264 | 12480 | 12540 | 60 | 6 | 1270 | |
| 154 | 1232 | 13712 | 13778 | 66 | 6 | 1238 | |
| 158 | 1264 | 14976 | 15048 | 72 | 6 | 1270 | |
| 154 | 1232 | 16208 | 16286 | 78 | 6 | 1238 | |
| 158 | 1264 | 17472 | 17556 | 84 | 6 | 1270 | |
| 154 | 1232 | 18704 | 18794 | 90 | 6 | 1238 | |
| 158 | 1254 | 19968 | 20064 | 96 | 6 | 1270 | |
| 154 | 1232 | 21200 | 21302 | 102 | 6 | 1238 | |
| 158 | 1264 | 22464 | 22572 | 108 | 6 | 1270 | |
| 154 | 1232 | 23696 | 23810 | 114 | 6 | 1238 | |
| 158 | 1264 | 24960 | 25080 | 120 | 6 | 1270 | |
| 154 | 1232 | 26192 | 26318 | 126 | 6 | 1238 | |
| 158 | 1264 | 27456 | 27588 | 132 | 6 | 1270 | |
| 154 | 1232 | 28688 | 28826 | 138 | 6 | 1238 | |
| 158 | 1264 | 29952 | 30096 | 144 | 6 | 1270 | |
| 154 | 1232 | 31184 | 31334 | 150 | 6 | 1238 | |
| 158 | 1264 | 32448 | 32604 | 156 | 6 | 1270 | |
| 154 | 1232 | 33680 | 33842 | 162 | 6 | 1238 | |
| 158 | 1264 | 34944 | 35112 | 168 | 6 | 1270 | |
| 154 | 1232 | 36176 | 36350 | 174 | 6 | 1238 | |
| 158 | 1264 | 37440 | 37620 | 180 | 6 | 1270 | |

APPENDIX C

Print Mode: 1/2 Head Plain Paper
Normal E2E
Print Head Nozzles Used: 154
The divisor is used to determine the change in the original move length to attain the desired feedrate change while only altering the feedrate over print-head height by an integer value of 1 (2400ths)
divisor (4*9600ths) = 616 (3*9600ths) = 616

| Original move length (1200ths) | Original move length (9600ths) | Original Absolute Position (9600ths) | Adjusted Absolute Position (9600ths) | Difference between original Abs Pos and adjusted Abs Pos (9600ths) | Original move length (1200ths) | Original move length (9600ths) | Original Absolute Position (9600ths) |
|---|---|---|---|---|---|---|---|
| 50 | 400 | 400 | 402 | 2 | 50 | 400 | 400 |
| 158 | 1264 | 1664 | 1672 | 8 | 158 | 1264 | 1664 |
| 50 | 400 | 2064 | 2074 | 10 | 50 | 400 | 2064 |
| 50 | 400 | 2464 | 2476 | 12 | 50 | 400 | 2464 |
| 50 | 400 | 2864 | 2878 | 14 | 50 | 400 | 2864 |
| 158 | 1264 | 4128 | 4148 | 20 | 158 | 1264 | 4128 |
| 50 | 400 | 4528 | 4550 | 22 | 50 | 400 | 4528 |
| 50 | 400 | 4928 | 4952 | 24 | 50 | 400 | 4928 |
| 50 | 400 | 5328 | 5354 | 26 | 50 | 400 | 5328 |
| 158 | 1264 | 6592 | 6624 | 32 | 158 | 1264 | 6592 |
| 50 | 400 | 6992 | 7026 | 34 | 50 | 400 | 6992 |
| 50 | 400 | 7392 | 7428 | 36 | 50 | 400 | 7392 |
| 50 | 400 | 7792 | 7830 | 38 | 50 | 400 | 7792 |
| 158 | 1264 | 9056 | 9100 | 44 | 158 | 1264 | 9056 |
| 50 | 400 | 9456 | 9502 | 46 | 50 | 400 | 9456 |

APPENDIX C-continued

Print Mode: 1/2 Head Plain Paper
Normal E2E
Print Head Nozzles Used: 154
The divisor is used to determine the change in the original move length to attain the desired feedrate change while only altering the feedrate over print-head height by an integer value of 1 (2400ths)
divisor (4*9600ths) = 616 (3*9600ths) = 616

| Original move length (1200ths) | Original move length (9600ths) | Original Absolute Position (9600ths) | Adjusted Absolute Position (9600ths) | Difference between original Abs Pos and adjusted Abs Pos (9600ths) | Original move length (1200ths) | Original move length (9600ths) | Original Absolute Position (9600ths) |
|---|---|---|---|---|---|---|---|
| 50 | 400 | 9856 | 9904 | 48 | 50 | 400 | 9856 |
| 50 | 400 | 10256 | 10306 | 50 | 50 | 400 | 10256 |
| 158 | 1264 | 11520 | 11576 | 56 | 158 | 1264 | 11520 |
| 50 | 400 | 11920 | 11978 | 58 | 50 | 400 | 11920 |
| 50 | 400 | 12320 | 12380 | 60 | 50 | 400 | 12320 |
| 50 | 400 | 12720 | 12782 | 62 | 50 | 400 | 12720 |
| 158 | 1264 | 13984 | 14052 | 68 | 158 | 1264 | 13984 |
| 50 | 400 | 14384 | 14454 | 70 | 50 | 400 | 14384 |
| 50 | 400 | 14784 | 14856 | 72 | 50 | 400 | 14784 |
| 50 | 400 | 15184 | 15258 | 74 | 50 | 400 | 15184 |
| 158 | 1264 | 16448 | 16528 | 80 | 158 | 1264 | 16448 |
| 50 | 400 | 16848 | 16930 | 82 | 50 | 400 | 16848 |
| 50 | 400 | 17248 | 17332 | 84 | 50 | 400 | 17248 |
| 50 | 400 | 17648 | 17734 | 86 | 50 | 400 | 17640 |
| 158 | 1264 | 18912 | 19004 | 92 | 158 | 1264 | 18912 |

APPENDIX D

Print Mode: 1/2 Head Photo
Print Head Nozzles Used: 144
The divisor is used to determine the change in the original move length to attain the desired feedrate change while only altering the feedrate over print-head height by an integer value of 1 (2400ths)
Passes 16
divisor (3*9600ths) = 432

| Original move length (1200ths) | Original move length (9600ths) | Original Absolute Position (9600ths) | Adjusted Absolute Position (9600ths) | Difference between original Abs Pos and adjusted Abs Pos (9600ths) | Move to Move adjustment amount (9600ths) | Adjusted move length (9600ths) | Adjusted Feedrate % |
|---|---|---|---|---|---|---|---|
| 5 | 40 | 40 | 40 | 0 | 0 | 40 | 0.69444444 |
| 21 | 168 | 208 | 209 | 1 | 1 | 169 | |
| 5 | 40 | 248 | 250 | 2 | 1 | 41 | |
| 5 | 40 | 288 | 290 | 2 | 0 | 40 | |
| 5 | 40 | 328 | 330 | 2 | 0 | 40 | |
| 21 | 168 | 496 | 499 | 3 | 1 | 169 | |
| 5 | 40 | 536 | 540 | 4 | 1 | 41 | |
| 5 | 40 | 576 | 580 | 4 | 0 | 40 | |
| 5 | 40 | 616 | 620 | 4 | 0 | 40 | |
| 21 | 168 | 784 | 789 | 5 | 1 | 169 | |
| 5 | 40 | 824 | 830 | 6 | 1 | 41 | |
| 5 | 40 | 864 | 870 | 6 | 0 | 40 | |
| 5 | 40 | 904 | 910 | 6 | 0 | 40 | |
| 21 | 168 | 1072 | 1079 | 7 | 1 | 169 | |
| 5 | 40 | 1112 | 1120 | 8 | 1 | 41 | |
| 5 | 40 | 1152 | 1160 | 8 | 0 | 40 | |
| 5 | 40 | 1192 | 1200 | 8 | 0 | 40 | |
| 21 | 168 | 1360 | 1369 | 9 | 1 | 169 | |
| 5 | 40 | 1400 | 1410 | 10 | 1 | 41 | |
| 5 | 40 | 1440 | 1450 | 10 | 0 | 40 | |
| 5 | 40 | 1480 | 1490 | 10 | 0 | 40 | |
| 21 | 168 | 1648 | 1659 | 11 | 1 | 169 | |
| 5 | 40 | 1688 | 1700 | 12 | 1 | 41 | |
| 5 | 40 | 1728 | 1740 | 12 | 0 | 40 | |

APPENDIX D-continued

Print Mode: 1/2 Head Photo
Print Head Nozzles Used: 144
The divisor is used to determine the change in the original move length
to attain the desired feedrate change while only altering
the feedrate over print-head height by an integer value of 1 (2400ths)
Passes 16
divisor (3*9600ths) = 432

| Original move length (1200ths) | Original move length (9600ths) | Original Absolute Position (9600ths) | Adjusted Absolute Position (9600ths) | Difference between original Abs Pos and adjusted Abs Pos (9600ths) | Move to Move adjustment amount (9600ths) | Adjusted move length (9600ths) | Adjusted Feedrate % |
|---|---|---|---|---|---|---|---|
| 5 | 40 | 1768 | 1780 | 12 | 0 | 40 | |
| 21 | 168 | 1936 | 1949 | 13 | 1 | 169 | |
| 5 | 40 | 1976 | 1990 | 14 | 1 | 41 | |
| 5 | 40 | 2016 | 2030 | 14 | 0 | 40 | |
| 5 | 40 | 2056 | 2070 | 14 | 0 | 40 | |
| 21 | 168 | 2224 | 2239 | 15 | 1 | 169 | |

APPENDIX E

Print Mode: Glossy Photo
Print Head Nozzles Used: 152
The divisor is used to determine the change in the original move length
to attain the desired feedrate change while only altering
the feedrate over print-head height by an integer value of 1 (2400ths)
Passes 16
divisor (3*9600ths) = 456

| Original move length (1200ths) | Original move length (9600ths) | Original Absolute Position (9600ths) | Adjusted Absolute Position (9600ths) | Difference between original Abs Pos and adjusted Abs Pos (9600ths) | Move to Move adjustment amount (9600ths) | Adjusted move length (9600ths) | Adjusted Feedrate % |
|---|---|---|---|---|---|---|---|
| 17 | 136 | 136 | 137 | 1 | 1 | 137 | 0.65789473 |
| 21 | 168 | 304 | 306 | 2 | 1 | 169 | |
| 17 | 136 | 440 | 443 | 3 | 1 | 137 | |
| 21 | 168 | 608 | 612 | 4 | 1 | 169 | |
| 17 | 136 | 744 | 749 | 5 | 1 | 137 | |
| 21 | 168 | 912 | 918 | 6 | 1 | 169 | |
| 17 | 136 | 1048 | 1055 | 7 | 1 | 137 | |
| 21 | 168 | 1216 | 1224 | 8 | 1 | 169 | |
| 17 | 136 | 1352 | 1361 | 9 | 1 | 137 | |
| 21 | 168 | 1520 | 1530 | 10 | 1 | 169 | |
| 17 | 136 | 1656 | 1667 | 11 | 1 | 137 | |
| 21 | 168 | 1824 | 1836 | 12 | 1 | 169 | |
| 17 | 136 | 1960 | 1973 | 13 | 1 | 137 | |
| 21 | 168 | 2128 | 2142 | 14 | 1 | 169 | |
| 17 | 136 | 2264 | 2279 | 15 | 1 | 137 | |
| 21 | 168 | 2432 | 2448 | 16 | 1 | 169 | |
| 17 | 136 | 2568 | 2585 | 17 | 1 | 137 | |
| 21 | 168 | 2736 | 2754 | 18 | 1 | 169 | |
| 17 | 136 | 2872 | 2891 | 19 | 1 | 137 | |
| 21 | 168 | 3040 | 3060 | 20 | 1 | 169 | |
| 17 | 136 | 3176 | 3197 | 21 | 1 | 137 | |
| 21 | 168 | 3344 | 3366 | 22 | 1 | 169 | |
| 17 | 136 | 3480 | 3503 | 23 | 1 | 137 | |
| 21 | 168 | 3648 | 3672 | 24 | 1 | 169 | |
| 17 | 136 | 3784 | 3809 | 25 | 1 | 137 | |
| 21 | 168 | 3952 | 3978 | 26 | 1 | 169 | |
| 17 | 136 | 4088 | 4115 | 27 | 1 | 137 | |
| 21 | 168 | 4256 | 4284 | 28 | 1 | 169 | |
| 17 | 136 | 4392 | 4421 | 29 | 1 | 137 | |
| 21 | 168 | 4560 | 4590 | 30 | 1 | 169 | |

APPENDIX F

Print Mode: Glossy Normal
Print Head Nozzles Used: 156
The divisor is used to determine the change in the original move length to attain the desired feed rate change while only altering the feed rate over print-head height by an integer value of 1 (2400ths)
Passes 8
divisor (3*9600ths) = 468

| Original move length (1200ths) | Original move length (9600ths) | Original Absolute Position (9600ths) | Adjusted Absolute Position (9600ths) | Difference between original Abs Pos and adjusted Abs Pos (9600ths) | Move to Move adjustment amount (9600ths) | Adjusted move length (9600ths) | Adjusted Feed rate % |
|---|---|---|---|---|---|---|---|
| 37 | 296 | 296 | 298 | 2 | 2 | 298 | 0.64102564 |
| 41 | 328 | 624 | 628 | 4 | 2 | 330 | |
| 37 | 296 | 920 | 926 | 6 | 2 | 298 | |
| 41 | 328 | 1248 | 1256 | 8 | 2 | 330 | |
| 37 | 296 | 1544 | 1554 | 10 | 2 | 298 | |
| 41 | 328 | 1872 | 1884 | 12 | 2 | 330 | |
| 37 | 296 | 2168 | 2182 | 14 | 2 | 298 | |
| 41 | 328 | 2496 | 2512 | 16 | 2 | 330 | |
| 37 | 296 | 2792 | 2810 | 18 | 2 | 298 | |
| 41 | 328 | 3120 | 3140 | 20 | 2 | 330 | |
| 37 | 296 | 3416 | 3438 | 22 | 2 | 298 | |
| 41 | 328 | 3744 | 3768 | 24 | 2 | 330 | |
| 37 | 296 | 4040 | 4066 | 26 | 2 | 298 | |
| 41 | 328 | 4368 | 4396 | 28 | 2 | 330 | |
| 37 | 296 | 4664 | 4694 | 30 | 2 | 298 | |
| 41 | 328 | 4992 | 5024 | 32 | 2 | 330 | |
| 37 | 296 | 5288 | 5322 | 34 | 2 | 298 | |
| 41 | 328 | 5616 | 5652 | 36 | 2 | 330 | |
| 37 | 296 | 5912 | 5950 | 38 | 2 | 298 | |
| 41 | 328 | 6240 | 6280 | 40 | 2 | 330 | |
| 37 | 296 | 6536 | 6578 | 42 | 2 | 298 | |
| 41 | 328 | 6864 | 6908 | 44 | 2 | 330 | |
| 37 | 296 | 7160 | 7206 | 46 | 2 | 298 | |
| 41 | 328 | 7488 | 7536 | 48 | 2 | 330 | |
| 37 | 296 | 7784 | 7834 | 50 | 2 | 298 | |
| 41 | 328 | 8112 | 8164 | 52 | 2 | 330 | |
| 37 | 296 | 8408 | 8462 | 54 | 2 | 298 | |
| 41 | 328 | 8736 | 8792 | 56 | 2 | 330 | |
| 37 | 296 | 9032 | 9090 | 58 | 2 | 298 | |
| 41 | 328 | 9360 | 9420 | 60 | 2 | 330 | |

The foregoing description of several methods and embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for reducing banding during printing with an imaging apparatus, comprising:

a) establishing a current original move length for a sheet of media;

b) determining a current original absolute position for said sheet of media;

c) calculating a current adjusted absolute position for said sheet of media based on said current original absolute position;

d) determining a current difference between said current original absolute position and said current adjusted absolute position;

e) determining a current move-to-move adjustment amount by subtracting said current difference from a previous difference between a previous original absolute position and a previous adjusted absolute position; and f) generating an adjusted move length for a next move of said sheet of media by adding said current move-to-move adjustment amount to said current original move length.

2. The method of claim 1, further comprising repeating acts a) through f) until all print moves are completed.

3. The method of claim 1, wherein said current original absolute position and said current adjusted absolute position are cumulative move distances resulting from a series of moves.

4. The method of claim 1, wherein said calculating said current adjusted absolute position based on said current original absolute position is performed by the equation:

AdjAbsPos=int ((3*OrigAbsPos+Divisor/2)/Divisor)+OrigAbsPos, wherein:

AdjAbsPos is said current adjusted absolute position;

int is a function performing real number truncation to form an integer;

OrigAbsPos is said current original absolute position; and

Divisor is an established constant that is based on an effective printhead height.

5. The method of claim 4, wherein said Divisor is chosen such that the adjustment is evenly distributed over essentially any effective printhead height.

6. The method of claim 1, wherein said method is performed via program steps executed by a controller associated with said imaging apparatus.

7. The method of claim 1, wherein said banding is dark horizontal bands.

8. An imaging apparatus having a controller, a print engine, a media transport system, and a power drive apparatus, said power drive apparatus being drivably coupled to said media transport system for supplying a sheet of media to, through and from an imaging area of said print engine, said controller being communicatively coupled to said print engine and said power drive apparatus, said controller executing program instructions for reducing banding during printing with said imaging apparatus, comprising:

a) establishing a current original move length for said sheet of media;

b) determining a current original absolute position for said sheet of media;

c) calculating a current adjusted absolute position for said sheet of media based on said current original absolute position;

d) determining a current difference between said current original absolute position and said current adjusted absolute position;

e) determining a current move-to-move adjustment amount by subtracting said current difference from a previous difference between a previous original absolute position and a previous adjusted absolute position; and f) generating an adjusted move length for a next move of said sheet of media by adding said current move-to-move adjustment amount to said current original move length.

9. The imaging apparatus of claim 8, further comprising repeating acts a) through f) until all print moves are completed.

10. The imaging apparatus of claim 8, wherein said current original absolute position and said current adjusted absolute position are cumulative move distances resulting from a series of moves.

11. The imaging apparatus of claim 8, wherein said print engine carries a printhead, and said calculating said current adjusted absolute position based on said current original absolute position is performed by the equation:

AdjAbsPos=int (( 3* OrigAbsPos+Divisor/2)/Divisor)+OrigAbsPos, wherein:

AdjAbsPos is said current adjusted absolute position;

int is a function performing real number truncation to form an integer;

OrigAbsPos is said current original absolute position; and Divisor is an established constant that is based on an effective printhead height.

12. The imaging apparatus of claim 11, wherein said Divisor is chosen such that the adjustment is evenly distributed over essentially any effective printhead height.

13. The imaging apparatus of claim 8, wherein said banding is dark horizontal bands.

* * * * *